United States Patent [19]

Pidgeon

[11] Patent Number: 4,886,399

[45] Date of Patent: Dec. 12, 1989

[54] METHOD OF CONSTRUCTING A FOUNDATION FOR BUILDINGS

[76] Inventor: John T. Pidgeon, 417 Milner St., Waterkloof, Pretoria, Transvaal Province, South Africa

[21] Appl. No.: 154,846

[22] Filed: Feb. 10, 1988

[30] Foreign Application Priority Data

Feb. 12, 1987 [ZA] South Africa ..... 87/1045

[51] Int. Cl.[4] ..... E02D 27/00

[52] U.S. Cl. ..... 405/229; 52/169.1; 52/742

[58] Field of Search ..... 405/229, 258, 267; 52/169.1, 742, 743

[56] References Cited

U.S. PATENT DOCUMENTS 4,089,183 5/1978 Endo et al. ..... 405/267

FOREIGN PATENT DOCUMENTS 1080764 12/1954 France ..... 405/229
200221 9/1986 Japan ..... 405/229
683928 6/1968 South Africa .
701970 4/1970 South Africa .
718452 12/1971 South Africa .
760387 1/1975 South Africa .
767032 11/1976 South Africa .
812891 4/1981 South Africa .
821552 3/1982 South Africa .
859415 12/1985 South Africa .
862856 4/1986 South Africa .
870585 1/1987 South Africa .
872606 4/1987 South Africa .

OTHER PUBLICATIONS

"Residential Slabs on Ground", Engineering Foundation Research Conference on Expansive Soils, 1968, p. 5.

"The Design of Residential Slabs-on-Ground", P. F. Walsh, p. 2.

Vol. 1 of the Fourth International Conference on Expansive Soils, Editor—Donald Snethen, p. 563.

"Design and Construction of Post-Tensioned Slabs-on-Ground", Post-Tensioning-Institute, p. 24.

"Criteria for Selection and Design of Residential Slabs-on-Ground", U.S. Dept. of Commerce National Technical Information Service-PB-261-551, 1968, pp. 33, 59.

"Residential Slab Research—Recent Findings", J. E. Holland, p. 91.

*Primary Examiner*—David H. Corbin

*Attorney, Agent, or Firm*—Michael N. Meller

[57] ABSTRACT

A method of constructing a foundation 10 for a building includes forming in the ground a grid 12 of intersecting foundation trenches 14, 16. The grid 12 is made up of two sets of substantially parallel trenches, the trenches of the sets being respectively designated 14 and 16, each trench 14, 16 of each set intersecting at least one trench of the other set. Settable material, eg concrete, is continuously cast within the trenches 14, 16 to obtain an integral grid 18 of two sets of intersecting foundation between 20 (in the trenches 16) and 22 (in the trenches 14). The spacing A between adjacent pairs of trenches 14 or 16 and between adjacent pairs of parallel beams 20 or 22 of the grid 18 is 1,5 meters. A covering of concrete is continuously cast over the beams 20 and 22 and integral therewith, to obtain a slab 24 (FIG. 3) covering the beams and the ground 26 between the beams 20 and 22, the slabs having a flat upper surface 28 (FIG. 3).

14 Claims, 2 Drawing Sheets

METHOD OF CONSTRUCTING A FOUNDATION FOR BUILDINGS

This invention relates to a method of constructing a foundation for a building.

According to the invention, there is provided a method of constructing a foundation for a building which includes forming in the ground a grid of intersecting foundation trenches, the grid being made up of two sets of substantially parallel trenches, each trench of each set intersecting at least one trench of the other set;

continuously casting settable material within the trenches to obtain an integral grid of intersecting foundation beams, the spacing between adjacent trenches and parallel beams of the grid being from 1–2 meters; and continuously casting a covering of settable material over the beams and integral therewith, to obtain a slab covering the ground between the beams and having a flat upper surface.

By "continuously casting" is meant that the settable material forming the grid of beams and the covering slab is cast in a fashion such that, as settable material is being cast, it is cast in contact with settable material which has been cast earlier, but which has not yet set, so that after the casting is complete the slab and grid of beams together constitute an integral or unitary foundation without discontinuities caused by the casting of material in contact with previously cast material which has already set.

The spacing between adjacent parallel trenches and beams of the grid may be from 1,3–1,7 meters, eg about 1,5 meters, and the grid may be a square grid.

The width of each foundation beam may be from 100–170 mm, preferably 120–160 mm and in particular about 150 mm.

The vertical spacing from the bottom of each trench to the flat upper surface of the slab may be from 300–1500 mm, preferably 600–900 mm and in particular about 900 mm.

The thickness of the covering slab may be from 75–125 mm, preferably 90–110 mm and in particular about 100 mm.

Forming the grid of intersecting foundation trenches may be such that they are substantially rectangular in cross-section so that the cast beams each have a pair of laterally spaced vertical side faces and a horizontal lower face, the method including the step of reinforcing each foundation beam by embedding a reinforcing bar therein and by embedding a reinforcing bar in the slab above the beam at a position centrally above the beam, the bar in the beam extending parallel to the beam in the interior thereof along the length of the beam midway between the side faces of the beam, and the bar in the slab above the beam extending along the length of the beam parallel to the bar embedded in the beam, each bar being spaced by at least 50 mm from the outer surface of the cast foundation. It follows that the two reinforcing bars will be vertically spaced and parallel to each other and will have their axes located in the same vertical plane.

Each of the bars may have a cross-section which has an area which is from 0,1–0,25% of the cross-sectional area of the beam below a level which is midway between the lower face of the beam and the upper surface of the slab. In other words, if the side faces of the beam are projected upwardly to the top of the slab, each of the bars will have a cross-sectional area which is 0,2–0,5% of the sum of the cross-sectional area of the beam and the cross-sectional area of the part of the slab above the beam bounded by said projections.

Naturally, if desired, the slabs and/or beams may be otherwise reinforced, in addition to or instead of said reinforcing bars. Any suitable reinforcing material such as a wire mesh or grid may be used, eg in the slab, and reinforcing bars may be used in positions other than those described above.

The method may include forming a boundary trench which defines the outer periphery of the foundation in plan view, each of the trenches of the grid of the foundation intersecting the boundary trench, the method including continuously casting settable material in the boundary trench to obtain a boundary beam in the boundary trench which is integral with the beams of the grid and integral with the slab.

Forming the boundary trench may be such that a boundary beam made up of a plurality of straight portions at right angles to one another is obtained, which portions intercept one another in series at their ends to provide corners for the foundation when seen in plan view outline.

Forming the boundary trench may be such that the portions of the boundary beam obtained are each parallel to one of the sets of parallel trenches of the grid.

Instead, forming the boundary trench may be such that none of said portions is obtained which is parallel to either of the sets of trenches of the grid. In this case, forming the boundary trench may be such that each of said portions is inclined at an angle of 45° to the foundation trenches of the grid, forming the grid of intersecting foundation trenches being such that at least some of the foundation trenches intersect the boundary trench at the corners of the foundation. Preferably the trenches are formed such that each of the corners of the foundation is intersected by at least one of the foundation trenches.

Forming the grid of intersecting foundation trenches may be effected by a means of a cable trenching machine.

The method may include the step of laying a moisture resistant barrier in the foundation trenches and in the boundary trenches, before casting the foundation beams and boundary beams.

The invention extends to a foundation for a building, which foundation includes an integral grid of intersecting foundation beams of set settable material located within a grid of intersection foundation trenches in the ground, the grid of foundation beams being made up of two sets of substantially parallel foundation beams, each beam of each set intersecting at least one beam of the other set, the spacing between adjacent parallel beams of the grid being from 1–2 meters; and a covering of settable material over the beams and integral therewith, forming a slab covering the ground between the beams and having a flat upper surface.

The invention will now be described by way of example with reference to the accompanying diagrammatic drawings, not to scale, in which.

Figure 1:
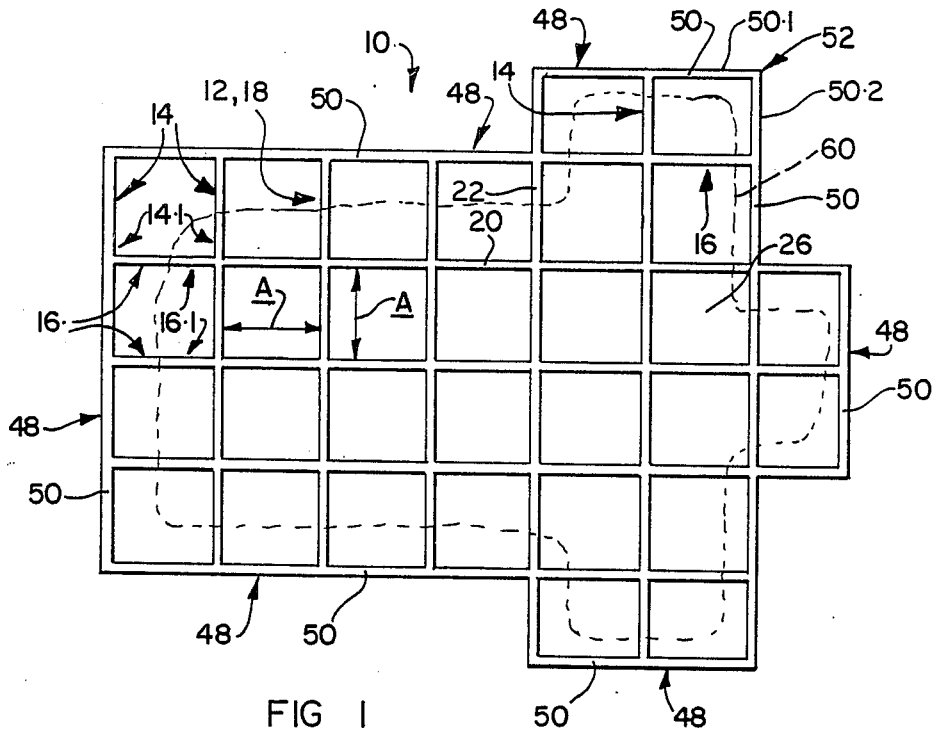
FIG. 1 shows a schematic plan view of an embodiment of a foundation constructed according to the method of the invention.

In the drawings, reference numeral 10 generally indicates a foundation constructed according to the method of the invention.

Figure 3:
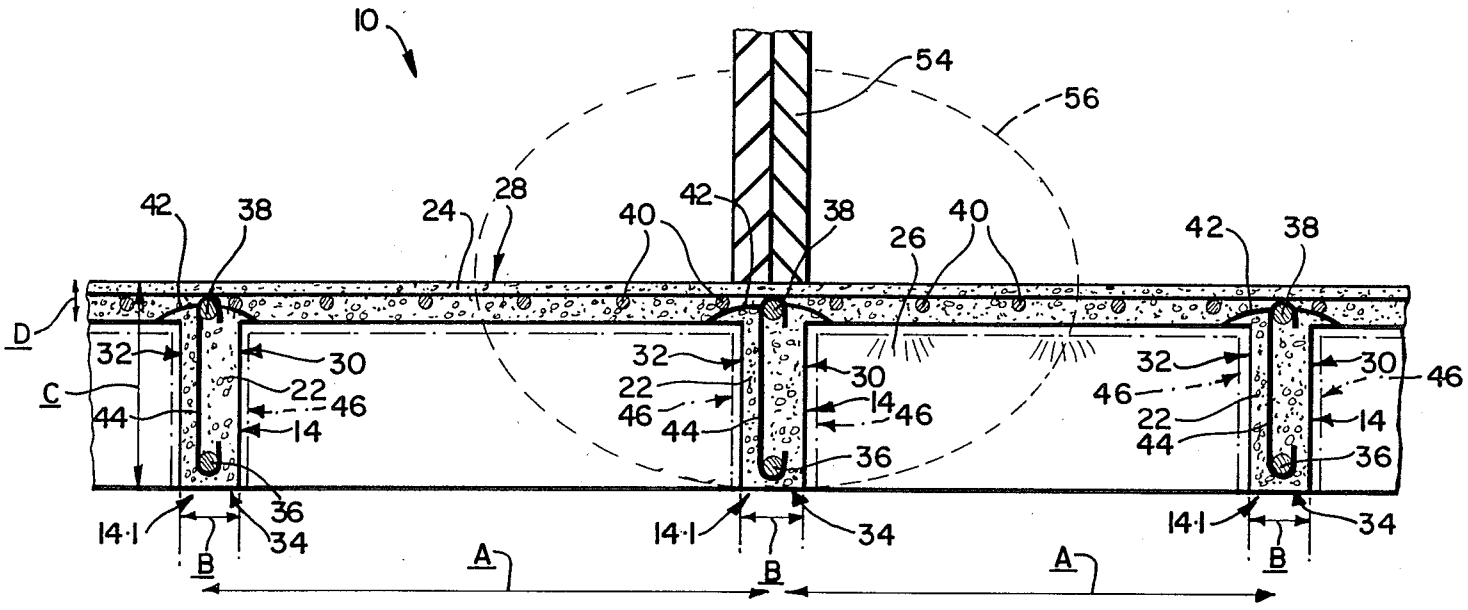
FIG. 3 shows a fragmentary schematic sectional side view of a foundation according to the invention, and a wall built above the beam of the foundation.

A method of constructing a foundation 10 for a building according to the invention includes forming in the ground a grid 12 of intersecting foundation trenches 14, 16. The grid 12 is made up of two sets of substantially parallel trenches, the trenches of the sets being respectively designated 14 and 16, each trench 14, 16 of each set intersecting at least one trench of the other set. Settable material, eg concrete, is continuously cast within the trenches 14, 16 to obtain an integral grid 18 of two sets of intersecting foundation beams 20 (in the trenches 16) and 22 (in the trenches 14). The spacing A between adjacent pairs of trenches 14 or 16 and between adjacent pairs of parallel beams 20 or 22 of the grid 18 is 1,5 meters. A covering of concrete is continuously cast over the beams 20 and 22 and integral therewith, to obtain a slab 24 (FIG. 3) covering the beams and the ground 26 between the beams 20 and 22, the slabs having a flat upper surface 28 (FIG. 3).

As mentioned above the spacing A between adjacent parallel trenches 14, 16 and beams 20, 22 of the grid is 1,5 meters. The width B of each foundation beam 20, 22 is 150 mm, and the vertical spacing C from the bottom of each trench 14, 16 (FIG. 3) to the flat upper surface 28 of the slab 24 is 900 mm. The thickness D of the covering slab 24 is 125 mm.

Forming the grid 12 of intersecting foundation trenches 14, 16 is such that they are substantially rectangular in cross-section, so that the cast beams 20, 22 each have a pair of laterally spaced vertical side faces 30, 32 and a horizontal lower face 34. The method includes the step of reinforcing each foundation beam 20, 22 by embedding a reinforcing bar 36 therein and by embedding a reinforcing bar 38 in the slab 24 above the beam 22. The bar 36 in the beam 22 extends parallel to the beam 22 in the interior thereof along the length of the beam 22, midway between the side faces 30 and 32 of the beam 22, and the bar 38 in the slab 24 above the beam 22 extends along the length of the beam 22 parallel to the bar 36 embedded in the beam 22. Each bar 36, 38 is spaced by at least 50 mm from the outer surface 30, 32 or 28 as the case may be, of the cast foundation 10. This provides an adequate thickness of concrete between the bars and the soil or ground, to slow corrosion of the bars by soil, water, and dissolved salts.

Each of the bars 36, 38 has a cross-section which has an area being from 0,1–0,25% of the cross-sectional area of the beam 22 below a level which is midway between the lower face 34 of the beam 22 and the upper surface 28 of the slab 24. This cross-sectional area of the beam can be expressed by $$\frac{B \times C}{2}.$$

The covering slab 24 is reinforced with a reinforcing steel mesh having a mass of typically 311 kg/m$^2$. Instead, mild steel bars (not shown) can be used, arranged in a grid having a grid opening size not greater than 300 mm and having an equivalent mass per unit area.

The reinforcing bar 38 which is in the covering slab 24 is supported before casting of the concrete by saddles 42 straddling the trenches 14, 16. The reinforcing bars 36, 38 are interconnected by means of hangers 44 bent around or spot welded to the bars 36, 38, so that each bar 30 is suspended from the associated bar 38.

The method includes laying a moisture resistant barrier 46 in the form of a 250 micron layer of plastics sheeting in the foundation trenches 14, 16 before casting the foundation beams 20, 22.

The method includes forming a boundary trench 48 which defines the outer periphery of the foundation 10 in plan view, each of the trenches 14, 16 of the grid 12 of the foundation 10 intersecting the boundary trench 48. The method includes continuously casting concrete in the boundary trench 48 to obtain a boundary beam 50 in the boundary trench 48 which is integral with the beams 20, 22 of the grid 18, and integral with the slab 24.

Forming the boundary trench 48 is such that the boundary beam 50 made up of a plurality of straight portions at right angles to one another, eg portions 50.1 and 50.2, is obtained, which portions intercept one another in series at their ends to provide a foundation 10 having rectangular corners 52 in plan view outline.

In the embodiment of the invention shown in FIG. 1 of the drawings, forming the boundary trench 48 is such that the portions of the boundary beam obtained are each parallel to one of the sets of parallel trenches 14, 16 of the grid. Thus portion 50.1 is parallel to trenches 16 of the grid, portion 50.2 being parallel to trenches 14 of the grid 12, and so on.

Figure 2:
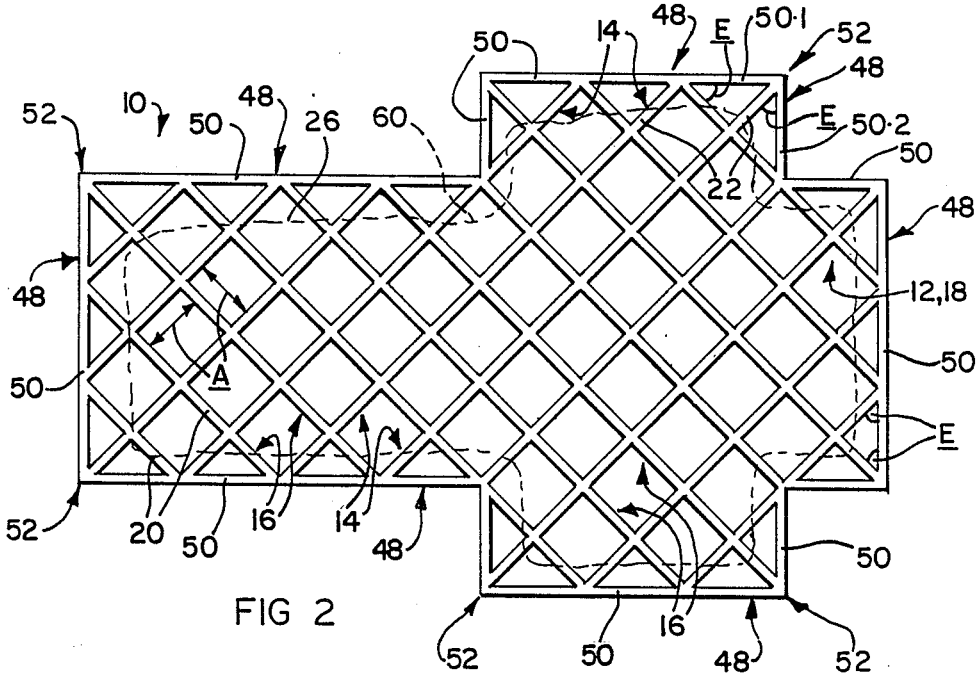
FIG. 2 shows a schematic plan view of another embodiment of a foundation constructed according to the method of the invention.

In the embodiment shown in FIG. 2 of the drawings, forming the boundary trench 48 is such that none of said portions, eg 50.1 and 50.2, obtained is parallel to either of the sets of trenches 14, 16 of the grid 12. More particularly, as shown in FIG. 2 of the drawings, forming the boundary trench 48 is such that each of said portions 50.1 and 50.2 is inclined at an angle E of 45° to both the foundation trenches 14 and the trenches 16 of the grid 12. Furthermore, forming the grid 12 of intersecting foundation trenches 14, 16 is such that each of the corners 52 of the foundation 10 is intersected by at least one of the foundation trenches 14, 16. In this manner, after the concrete has been cast into the foundation trenches 14, 16 and boundary trenches 48, corners 52 formed by intersecting straight portions of boundary beams 50.1 and 50.2 are supported cantilever fashion by at least one foundation beam 20, 22.

Forming the grid of intersecting foundation trenches 14, 16 is effected by means of a cable trenching machine (not shown). This provides a simple and inexpensive way of making rectangular trenches of the type in question, employing little labour.

It is an advantage of the method and foundation 10 of the invention, that they are particularly suited to troublesome soil conditions such as expansive soils.

Furthermore, because of the relative low width B of the beams 20, 22 of the foundation 10, the beams 20, 22 can be cast relatively close together so that the spacing A between adjacent beams in the foundation 10 is not less than 1 meter and not more than 2 meters. As a result of this, a relatively high proportion of covering slab 24 is able to co-operate with the beams 20, 22, thereby to provide greater flexural strength and stability to the foundation 10. In particular the slabs 24 can be regarded as cooperating with the beams 20, 22 to provide a plurality of T-beams (see the zone 56 in FIG. 3), which T-beams are linked together in series at the extremities of their arms, the arms having lengths which are low enough to resist sagging between the beams 20, 22. This has the further advantage that the need for localised thickening of the covering slab 24 in positions where a wall as shown at 54 is to be erected over the foundation 10, is reduced if not obviated. Consequently, the foundation 10 according to the invention lends itself to substantial flexibility as regards construction plan layouts, and is thus more versatile than conventional foundations known to the Applicant.

Yet another advantage of the method and foundation 10 according to the invention is that, due to the relative low width B of the foundation beams 20 and 22, less concrete and reinforcing steel is required in order to provide a foundation of suitable stiffness for a given construction plan layout, than with conventional foundations known to the Applicant. This results in a substantial reduction in material costs in building operations, particularly in the building of houses.

A yet further advantage of the particular embodiment of the method and foundation 10 shown in FIG. 2 of the drawings, is that each of the corners 52 of the foundation 10 are supported cantilever fashion by at least one beam 22. This strengthens the corners 52 against sagging, eg when a mound 60 (shown in dotted lines in FIGS. 1 and 2 of the drawings) develops in the soil beneath the foundation 10. The mound 60 is typically spaced inwardly of the boundary beam 50 of the foundation, tending to raise the foundation so that the boundary beam 50 and corners 52 are suspended cantilever fashion off the mound 60.

I claim:

1. In a method of constructing a stiffened raft foundation for a building which includes forming in the ground a grid of intersecting foundation trenches, the grid being made up of two sets of substantially parallel trenches, each trench of each set intersecting at least one trench of the other set;

continuously casting settable material within the trenches to obtain an integral grid of intersecting foundation beams; and continuously casting a covering of settable material over the beams and integral therewith, to obtain a slab covering the ground between the beams and having a flat upper surface, the improvement of forming the trenches such that the spacing between adjacent parallel beams of the grid is 1 to 2 meters, and the width of each foundation beam is 100 to 170 mm.

2. A method as claimed in claim 1 wherein the spacing between adjacent parallel trenches and beams of the grids is 1.3–1.7 meters.

3. A method as claimed in claim 2 wherein the vertical spacing from the bottom of each trench to the flat upper surface of the slab is 300 to 1500 mm.

4. A method as claimed in claim 3 wherein the thickness of the covering slab is 75–125 mm.

5. A method as claimed in claim 1 wherein forming the grid of intersecting foundation trenches is such that they are substantially rectangular in cross-section so that the cast beams each have a pair of laterally spaced vertical side faces and a horizontal lower face, the method including the step of reinforcing each foundation beam by embedding a reinforcing bar therein and by embedding a reinforcing bar in the slab above the beam at a position centrally above the beam, the bar in the beam extending parallel to the beam in the interior thereof along the length of the beam midway between the side faces of the beam, and the bar in the slab above the beam extending along the length of the beam parallel to the bar embedded in the beam, each bar being spaced by at least 50 mm from the outer surface of the cast foundation.

6. A method as claimed in claim 5 wherein each of the bars has a cross-section which has an area which is from 0.1–0.25% of the cross-sectional area of the beam below a level which is midway between the lower face of the beam and the upper surface of the slab.

7. A method as claimed in claim 1 which includes forming a boundary trench which defines the outer periphery of the foundation in plan view, each of the trenches of the grid of the foundation intersecting the boundary trench, the method including continuously casting settable material in the boundary trench to obtain a boundary beam in the boundary trench which is integral with the beams of the grid and integral with the slab.

8. A method as claimed in claim 7 wherein forming the boundary trench is such that a boundary beam made up of a plurality of straight portions at right angles to one another is obtained, which portions intercept one another in series at their ends to provide corners for the foundation when seen in plan view outline.

9. A method as claimed in claim 8 wherein forming the boundary trench is such that the portions of the boundary beam obtained are each parallel to one of the sets of parallel trenches of the grid.

10. A method as claimed in claim 8 wherein forming the boundary trench is such that none of said portions is obtained which is parallel to either of the sets of trenches of the grid.

11. A method as claimed in claim 10 wherein forming the boundary trench is such that each of said portions is inclined at an angle of 45° to the foundation trenches of the grid, and wherein forming the grid of intersecting foundation trenches is such that at least some of the foundation trenches intersect the boundary trench at the corners of the foundation.

12. A method as claimed in claim 1 wherein forming the grid of intersecting foundation trenches is effected by a means of a cable trenching machine.

13. In a stiffened raft foundation for a building, which foundation includes an integral grid of intersecting foundation beams of set settable material located within a grid of intersecting foundation trenches in the ground, the grid of foundation beams being made up of two sets of substantially parallel foundation beams, each beam of each set intersecting at least one beam of the other set; and a covering of settable material over the beams and integral therewith forming a slab covering the ground between the beams and having a flat upper surface, the improvement whereby the spacing between adjacent parallel beams of the grid is 1 to 2 meters, and the width of each foundation beam is 100 to 170 mm.

14. A foundation when constructed by the method claimed in claim 1.

* * * * *